United States Patent [19]

Medow

[11] Patent Number: 4,685,570

[45] Date of Patent: Aug. 11, 1987

[54] ACTIVITY TOTE

[76] Inventor: Sheila Medow, 5013 Elm St., Skokie, Ill. 60077

[21] Appl. No.: 813,015

[22] Filed: Dec. 24, 1985

[51] Int. Cl.[4] ..... B65D 69/00; A45C 11/36; A45C 15/00

[52] U.S. Cl. ..... 206/579; 206/1.7; 206/45.34; 206/214; 206/216; 206/450; 206/472; 190/901; 150/52 B; 383/39; 383/40

[58] Field of Search ..... 190/11, 109, 901, 119, 190/900; 150/52 B, 52 R; 206/214, 579, 459, 1.7, 472, 216, 45.34, 450, 473; 383/4, 17, 39, 40; D3/43; 108/43; 402/80 P, 74, 4; 281/31; 40/359, 405; D19/78, 86; 229/72

[56] References Cited

U.S. PATENT DOCUMENTS

| | | | |
|---|---|---|---|
| D. 271,917 | 12/1983 | Magis | D3/43 X |
| 433,536 | 8/1890 | Murdock | 206/214 |
| 954,113 | 4/1910 | Kraemer | 383/17 X |
| 954,840 | 4/1910 | Wiedemann | 383/4 X |
| 1,849,771 | 3/1932 | Smith et al. | 206/214 X |
| 2,053,630 | 9/1936 | Plotkin | 190/901 X |
| 3,143,748 | 8/1964 | Manning | 383/4 X |
| 4,318,471 | 3/1982 | Hutton | 206/214 |
| 4,388,958 | 6/1983 | Dworkin | 150/52 B X |
| 4,391,370 | 7/1983 | Dalbo | 383/40 X |
| 4,580,667 | 4/1986 | Herwood | 383/39 X |

FOREIGN PATENT DOCUMENTS

| | | | |
|---|---|---|---|
| 2034102 | 12/1970 | France | 383/17 |

*Primary Examiner*—Stephen Marcus
*Assistant Examiner*—Sue A. Weaver
*Attorney, Agent, or Firm*—Paul H. Gallagher

[57] ABSTRACT

A sheet of plastic material folded at the middle and forming a pair of side panels, with the juncture edge between the panels lowermost and the panels extending upwardly therefrom, forming a tote. The ends and top are open, and the panels can be opened to a flat position. Plastic pocket pieces are secured to the panels, forming large pockets between themselves and the panels, and certain of those pocket pieces have additional pocket pieces secured thereto to form additional and smaller pockets. All of the plastic pieces are clear and all of the contents of the pockets can be seen from either side of the folded tote either in open or folded position. Plastic carrying handles are secured to the free edges of the panels, and a detachable shoulder strap is also provided. Reinforcing fabric strips are secured to the juncture edge and other edges. A large number of items are carried in the tote for small children, and the tote is most useful in travelling.

3 Claims, 10 Drawing Figures

ACTIVITY TOTE

FIELD OF THE INVENTION

The invention resides in the field of devices designed for keeping small children occupied, and includes a large number of items designed to hold the child's attention, and arranged in compact form for carrying.

OBJECTS OF THE INVENTION

A broad object of the invention is to provide a package of items for a small child, for the child to play with to hold his attention, having the following features and advantages:

1. It is compact and easily carried in travelling with the child.
2. It is of such design and construction as to be easily carried by the child and otherwise manipulated and used by the child.
3. It includes a large number of items that hold a child's attention.
4. It is of transparent and clear material, enabling a person to see at a glance what is contained therein.
5. It is made of material that is generally flexible and easy and safe for a small child to handle, but possesses certain rigidity at least in certain directions to enable the child to use it as a lap board, or lap desk.
6. It is easily cleaned.

DESCRIPTION OF A PREFERRED EMBODIMENT

The device or item, or activity tote, or carrying bag, of the invention, is indicated in its entirety at 12. It is made up almost entirely, except for trimmings, handle, etc., of transparent sheet material, and includes a number of such sheets or plies, and for the specific mechanical construction thereof, attention is directed first to FIGS. 1, 2 and 5. The tote or device assumes a generally closed position represented in FIGS. 1, 2, in which it can be easily carried, and an opened up, or flat, position shown in FIGS. 3, 4, The tote includes a main sheet or piece 14 extending substantially throughout the device, and determining the size of the device, and to which, at least in part, other sheets are secured and which supports them. The large sheet, or main sheet, 14 is folded on a mid line 14*a* on a fold juncture edge, forming side panels 14*b*, 14*c*. Other sheets are secured to the main sheets, and secured in the overall structure for forming pockets, as identified individually and referred to hereinbelow.

Figure 1:
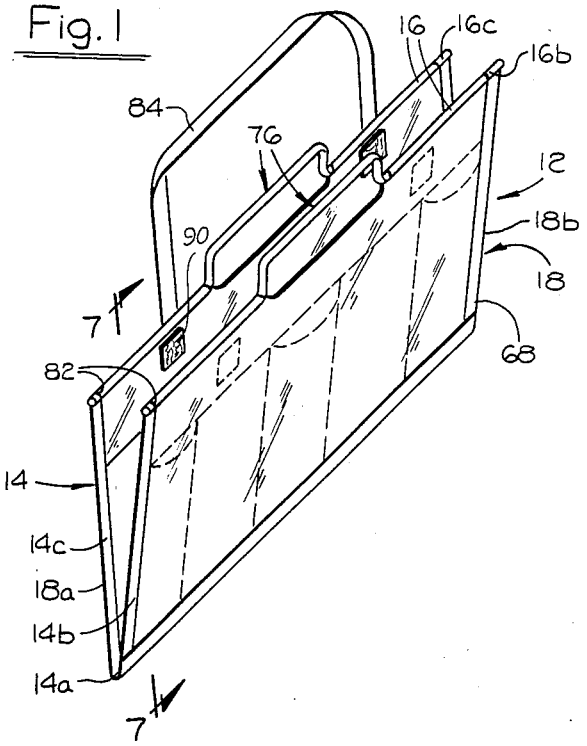
FIG. 1 is a perspective view of the activity tote of the invention, in upright position, for carrying.
Figure 2:
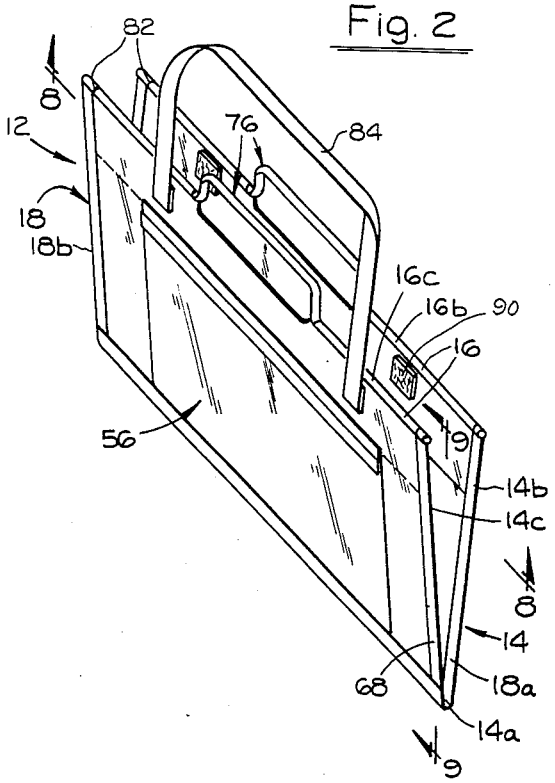
FIG. 2 is similar to FIG. 1 but showing the opposite side thereof.
Figure 3:
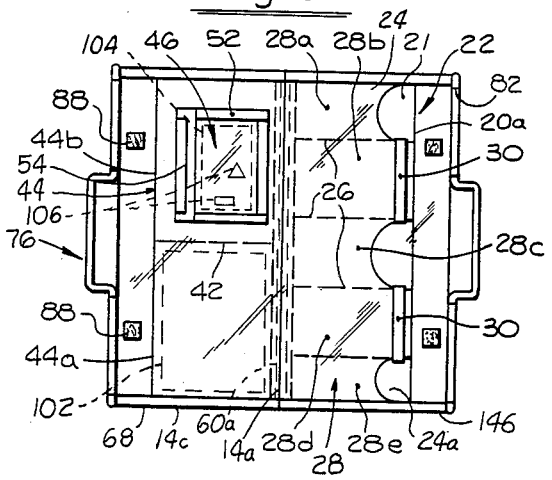
FIG. 3 is a face view of the tote spread in open position, showing the inner side.

For convenience in identifying the various parts, those parts may be referred to, at least at times, relative to the position of the tote as represented in FIGS. 1 and 2. In such position, the fold edge 14*a* forms the lower edge, and the panels have free edges, or swinging edges, or upper edges, 16, individually identified 16*b*, 16*c*. The tote is also considered as having side edges 18, individually identified 18*a*, 18*b*, oriented according to carrying position, although the individual panels are longer in transverse direction than in vertical direction.

Positioned on the inner surface of the panel sheet 14*b* is a relatively large pocket sheet 20, extending the width of the sheet 14*b*, but preferably terminating upwardly short thereof as indicated at 20*a*, forming a relatively large pocket 22 therebetween extending the full width of the panel.

Positioned on the inner surface of the large pocket sheet 20 is a second pocket sheet 24 also extending the full length of the panel. This sheet 24 is secured to the sheet 20 as by stitching 26 extending perpendicularly from the fold line 14*a* toward the free edge of the panels. This stitching is at a number of locations, formlng relatively small pockets 28 individually identified 28a-e. Certain of these pockets are provided with closable flaps 30 for securing loose objects in those pockets as will be referred to again hereinbelow. These flaps can be readily moved to closed position and secured there and removed therefrom by securing means 32 (FIG. 7), of known kind which can be easily manipulated by a small child. Other pockets may remain open at their upper end, and the second pocket sheet 24 at those locations is cut out as at 24*a* (FIG. 3) to form short pockets for carrying various items that can be easily held in place and grasped by a small child.

Positioned on the inner surface of the panel 14*c* is a first pocket piece 36, extending the width of the panel and forming therebetween a main pocket 38 also extending the width of the panel.

Positioned on the inner surface of the pocket piece 36 is another pocket piece 40 also extending the width of the panel but secured to the first pocket piece 36 at a center position as by stitching 42 (FIG. 3), forming pockets 44, individually identified 44*a*, 44*b*. Preferably these pocket pieces 38, 40 terminate upwardly short of the free edge of the panel. Positioned in these pockets also are articles to be carried as referred to hereinbelow.

Additionally, another pocket 46 is provided, made up of a pair of pieces 48, 50 fitted together and provided with a binding strip of fabric 52 surrounding three edges of the two pieces and around the free edge or flap 54 of the piece 48, the flap 54 being extended and folded down over the outer piece 50 to form a flap to the pocket. Also disposed in this pocket are play articles.

Figure 4:
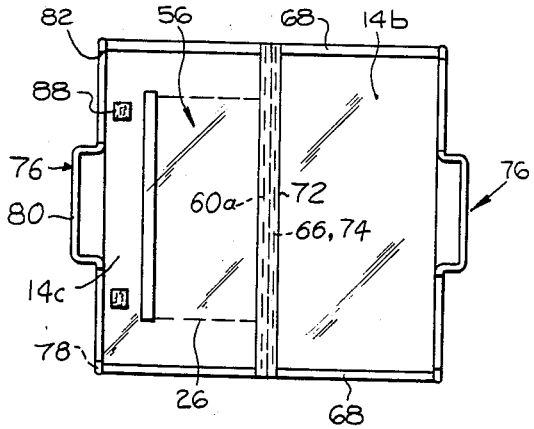
FIG. 4 is a face view of the tote spread in open position, showing the outer side.
Figure 5:
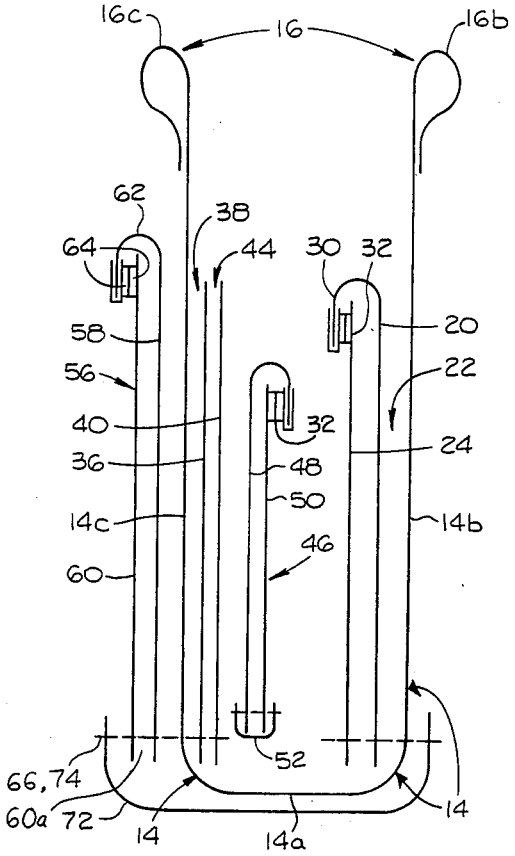
FIG. 5 is a edge view, diagrammatic in form, showing the sheets of material making up the device.
Figure 6:
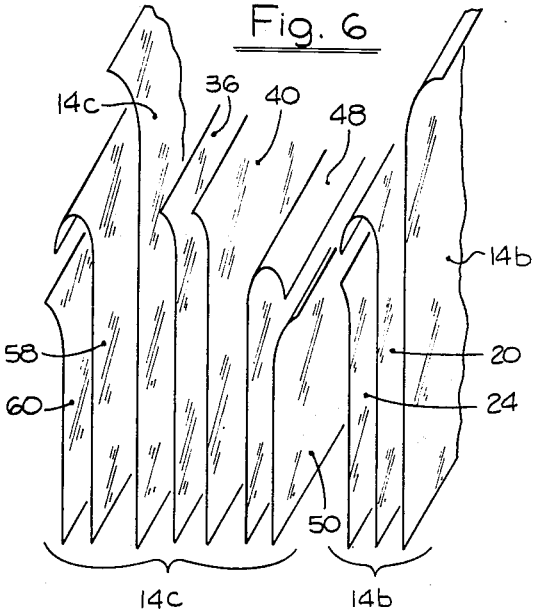
FIG. 6 is a diagrammatic view showing the sheets of FIG. 5 and indicating their transparency.

Another pocket 56 is provided on the outer surface of the panel 14*c*. This pocket is made up of an inner pocket piece 58 and an outer pocket piece 60, preferably extending less than the width of the panel, and together having a bottom edge or inner edge 60*g* terminating adjacent the fold line 14*a*, and terminating short of the free edge of the panel 14*c*. The inner pocket piece 58 is of greater dimension in the latter direction than the outer pocket piece, forming a flap 62 which is folded over the outer piece and provided with suitable securing means 64. These two pocket pieces, 58, 60, together are secured to the panel 14*c* as by stitching at 26 (FIG. 4).

Figure 8:
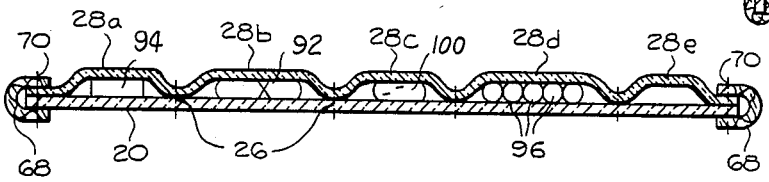
FIG. 8 is a sectional view taken at line 8—8 of FIG. 2, with details exaggerated.
Figure 9:
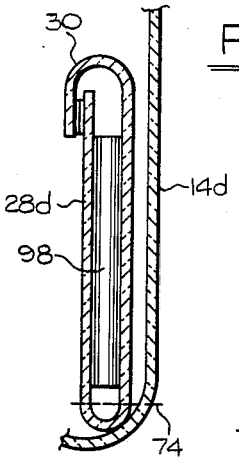
FIG. 9 is a sectional view taken at line 9—9 of FIG. 2, exaggerated in part.

All of the sheets referred to above, that extend the full length of the panels, are secured together by binding strips 68, which are preferably of fabric material, such as webbing or canvas, and of corresponding strength and toughness. These binding strips are folded over the corresponding edges of the sheets that are in multi-ply stack, and secured thereto as by stitching 70 (FIG. 8) which passes through both edges of the binding strips, and all of the sheets terminating at that point and positioned therebetween.

A reinforcing strip 72 is positioned over the fold edge 14*a* of the sheet 14 and secured thereto at its side edges (FIG. 7) by stitching 74, this stitching passing through not only the reinforcing strip, but through all of the edges at that location of the pocket sheets that extend to that point, namely (FIGS. 5, 7) 20. 24, 40, 36, 58, 60. This reinforcing strip may be of the character referred to above at 68, and provides a great reinforcing strength to the device, both in folded carrying position and in open position.

The free edges of the panels are provided with carrying handles. Preferably these handles are made of plastic material and are relatively rigid. Each handle includes straight end pieces 78 and a center bow 80, forming grip elements or loops for carrying. The end pieces 78 are secured to the panel as by looped hems 82 formed in the sheet 14. The bow 80 retains the handles in position, preventing them from being withdrawn by children.

While the carrying handles 76 provide a convenient means for carrying the tote, a shoulder strap 84 (FIGS. 1, 2, 10) may also be incorporated which may be of suitable material, such as the webbing referred to above, and is provided with securing elements 86 (FIG. 10) at its ends which adhere to corresponding securing elements 88 on the device. These latter elements 88 may be at any suitable position, adjacent a free edge of the panel, on either of the panels.

Figure 7:
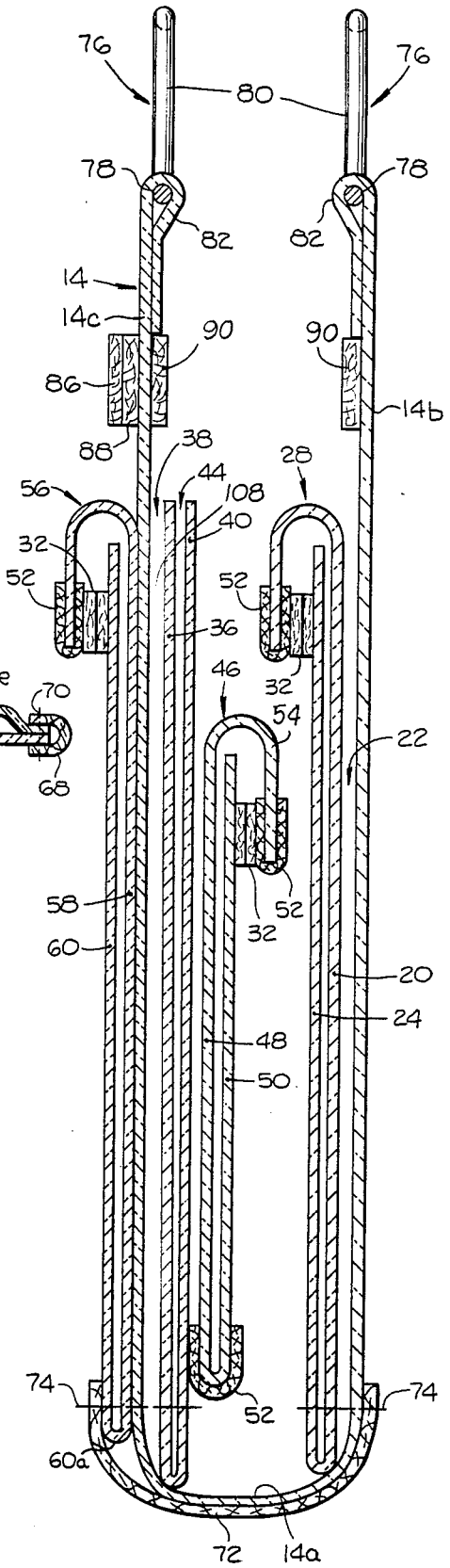
FIG. 7 is a sectional view taken at line 7—7 of FIG. 1, exaggerated in part.
Figure 10:
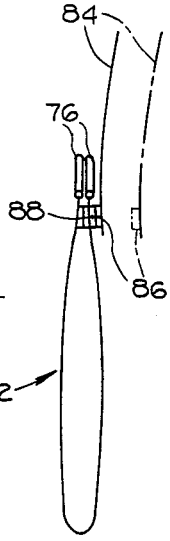
FIG. 10 is a diagrammatic end view showing the securing means for holding the tote in closed position, and for detachably securing the handle thereto.

FIG. 10 also represents diagrammatically the securing means 90 at the free edges of the panels, and readily releasing the panels (see also FIG. 7). These may be of "Velcro" material, adhering upon being merely pressed together, and readily separated upon being pulled apart.

All of the sheet elements identified above, are of transparent plastic material. Also as indicated above, they are entirely clear, whereby the articles in the pockets can be readily observed from either position, outside or inside.

The sheets of plastic, including not only the main sheets 14, but all of the sheets making up the pockets, together form a multi-ply construction which provides substantial strength to the device. The plastic material is relatively flexible, in bending about transverse axes, but possesses relative rigidity to resist crumpling or deformation by opposed forces acting transversely. While each sheet alone provides both of these characteristics, the plurality of them together, in each panel, provide greater rigidity, and the device when in folded form provides still greater rigidity. The entire item therefore is easily handled and manipulated by a small child, free of danger, and of such character that precautions against injury need not be taken. The rigidity provided by the multiple plies of material enables the device to be used as a lap board, or lap desk.

The device is well adapted to containment of various and many articles attractive to small children, which hold their interest while travelling, for example, rendering the device most useful for that purpose. For example, a pair of shears 92 may be provided in one of the pockets 28, these shears preferably being usable by both right handed and left handed children, and of course are without sharp edges. A pad of paper 94 may be carried in another of the pockets, while a package of crayons 96 may be carried in another pocket. Another item is a plurality of pieces of chalk 98 while in still another pocket is a sponge 100. The flaps 30 are particularly useful in the case of carrying small pieces, such as the pieces of chalk.

Another item to be carried for example is a blackboard 102 in the pocket 44*a*, the sponge being used to wipe the blackboard.

Still another article is a puzzle game, which includes a lap-size flannelboard 104 and a plurality of felt shapes and colors 106 in the pocket 46. It will be recalled that this pocket also includes a flap, 54, for holding the pieces therein. These pieces and the flannelboard are such that the pieces will adhere to the flannelboard merely by pressing them thereon. They can be put together to form larger image and representations.

Another item that might be carried is simply a poster or picture 108 in the pocket 38 which shows through of course to the outside. Still other items may be carried in the outermost pocket 44.

Another great advantage of the device or activity tote, is that the plastic material making up the sheets can be easily cleaned, merely by wiping it.

The overall character of the device is such that in ordinary handling, it remains closed and does not tend to swing open, which renders it particularly advantageous in use by small children, and this feature has particular significance in connection with the great strength and security provided by the binding webbing and the carrying handles.

I claim:

1. An activity tote comprising, a relatively large main sheet folded, forming a fold juncture edge and a pair of panels on opposite sides of that edge, the tote having a folded carrying position with the fold edge lowermost, the panels thereby having inner surfaces facing each other in the folded carrying position, and the panels having free edges extending upwardly, and having side edges, and with the free edges constituted by swinging edges parallel with and spaced from the fold edge, the panels being separate from each other at their side edges and free edges, the tote including pocket pieces on the inner surfaces of the panels having inner ends positioned closely adjacent the fold edge and oute ends adjacent to but spaced from the free edges of the panels, the pocket pieces being secured to the panels at the edges of the pocket pieces respectively adjacent the fold edge and side edges of the panels, thereby forming pockets of the pocket pieces having access ends at said outer ends of the pocket pieces, and the remaining edges of the pockets being closed, the pocket pieces extending the full width of the panels in direction between the side edges of the panels, each panel and the pocket pieces thereon forming a pack of at least three thicknesses including a single panel thickness and two pocket pieces, the tote including a reinforcing strip positioned on the outer surface of the main sheet, covering the fold edge and extending upwardly a short distance on the panels, the reinforcing strip extending the full width of the panels in direction between the side edges of the panels, the reinforcing strip being secured in its position by stitching therethrough and through the panels and pocket pieces together, at positions on opposite sides of the fold edge and closely adjacent thereto, the panels and pocket pieces, and thus the entire tote, except for small pieces including reinforcing strip, binding strips and securing elements, being of transparent material, and objects being easily viewable therein and therethrough, the panels and the pocket pieces being of limited flexibility about transverse axes, providing pliability to the tote as a whole, but possessing limited rigidity resisting crumpling by opposed forces applied thereto at the edges, the securement together of the reinforcing strip and panels and pocket pieces in direction between the side edges of the panels and the securement together of the pocket pieces and panels in direction perpendicular to the fold edge, together with the extension of the pocket pieces to position adjacent the free edges of the panels, providing great strength to the tote when in folded position, thereby enabling the tote when in folded position to be used effectively as a lap board, and the tote including carrying handles at the free edges of the panels.

2. An activity tote according to claim 1 together with, any of the following articles in said pockets:

scissors
sheets of paper
crayons
pieces of chalk
sponge wiper
blackboard
mounting panel and pieces that
adhere thereto by pressing
them thereagainst
charts
pictures.

3. An activity tote according to claim 1 wherein, the panels are provided adjacent their free edges, outwardly beyond the outer ends of the pocket pieces, with releaseable securing means including opposed interacting elements on the panels, operable for interlocking in response to pressing them together, and being separated in response to being pulled apart.

* * * * *